US007905365B2

(12) United States Patent
Virvo

(10) Patent No.: US 7,905,365 B2
(45) Date of Patent: Mar. 15, 2011

(54) DUAL CONTAINER DISPLAY WITH CENTER PANEL

(76) Inventor: Alexander Virvo, Stamford, CT (US)

( * ) Notice: Subject to any disclaimer, the term of this patent is extended or adjusted under 35 U.S.C. 154(b) by 453 days.

(21) Appl. No.: 11/295,751

(22) Filed: Dec. 7, 2005

(65) Prior Publication Data

US 2006/0151407 A1 Jul. 13, 2006

Related U.S. Application Data

(60) Provisional application No. 60/633,996, filed on Dec. 7, 2004.

(51) Int. Cl.
*A47G 29/00* (2006.01)

(52) U.S. Cl. ..... 211/73

(58) Field of Classification Search ..... 211/72, 211/73, 71.01, 135, 163, 144, 189; 206/45.25, 206/175, 193; 248/152, 174, 300
See application file for complete search history.

(56) References Cited

U.S. PATENT DOCUMENTS

| | | | | | |
|---|---|---|---|---|---|
| 1,959,619 | A * | 5/1934 | Ebert | 211/73 |
| 2,231,091 | A * | 2/1941 | Saulsbury | 221/133 |
| 2,671,584 | A * | 3/1954 | Taylor, Jr. | 206/760 |
| 2,851,237 | A * | 9/1958 | Welshenbach | 248/459 |
| 2,918,178 | A * | 12/1959 | Leone | 211/195 |
| 3,462,020 | A * | 8/1969 | Hall | 211/26.2 |
| 4,228,904 | A * | 10/1980 | Dumond | 211/55 |
| 4,230,258 | A * | 10/1980 | Lane | 206/585 |
| 4,485,922 | A * | 12/1984 | Desmond et al. | 206/485 |
| 4,570,805 | A * | 2/1986 | Smith | 211/149 |
| 5,183,166 | A * | 2/1993 | Belokin et al. | 211/149 |
| 5,213,220 | A * | 5/1993 | McBride | 211/132.1 |
| 6,269,961 | B1 * | 8/2001 | Porcelli | 211/70.7 |
| 6,279,757 | B1 * | 8/2001 | Hayoun | 211/40 |
| 2005/0184015 | A1 * | 8/2005 | Cypranowski et al. | 211/73 |

* cited by examiner

*Primary Examiner* — Jennifer E. Novosad
(74) *Attorney, Agent, or Firm* — Hoffman Warnick LLC

(57) ABSTRACT

A presentation display for use in displaying products, samples, premiums or the like comprises a center panel, a left tray, and a right tray wherein the left tray is attached to the center panel and the right tray is attached to the center panel. The presentation display is made from a single piece of paperboard or like flexible material. Shelves may be added or created from the same paperboard to hold products in the right and left trays.

2 Claims, 4 Drawing Sheets figure 4
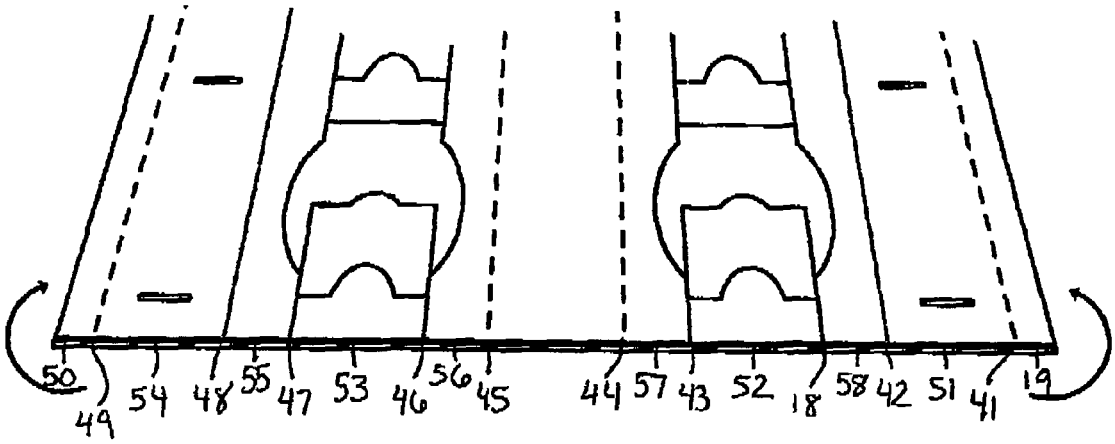
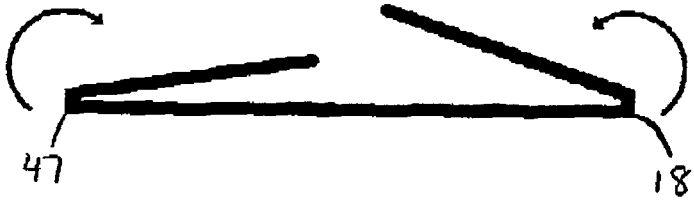
figure 5
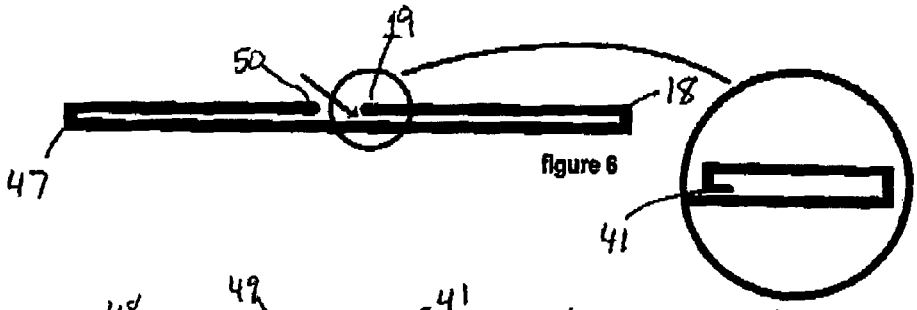
figure 6
figure 7
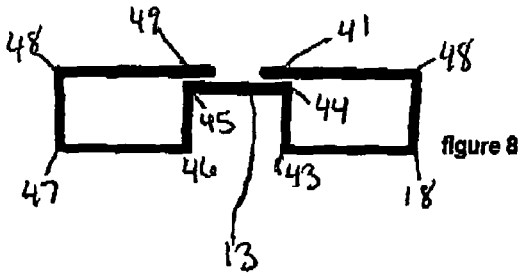
figure 8 figure 9
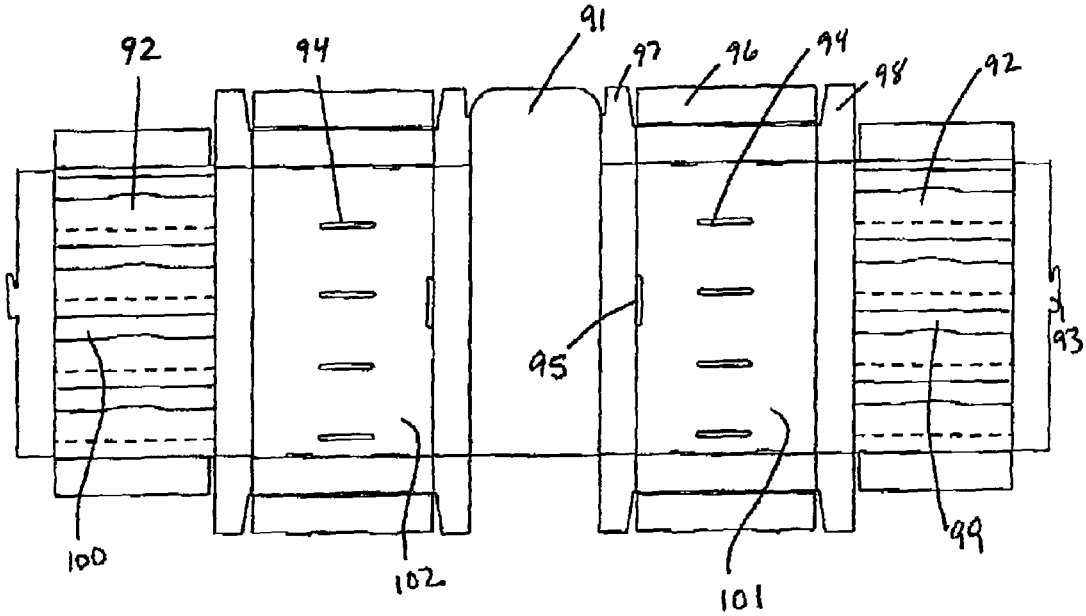
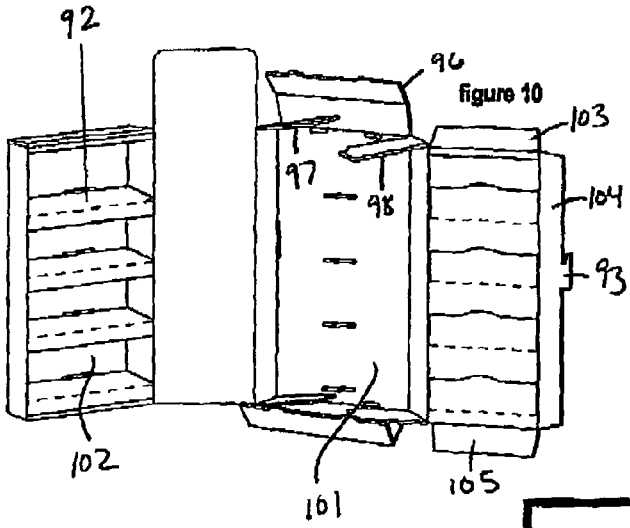
figure 10
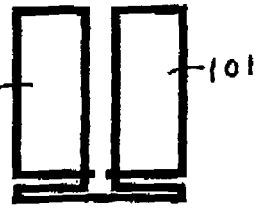
figure 11
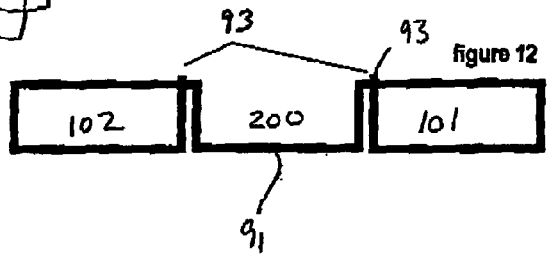
figure 12 figure 13
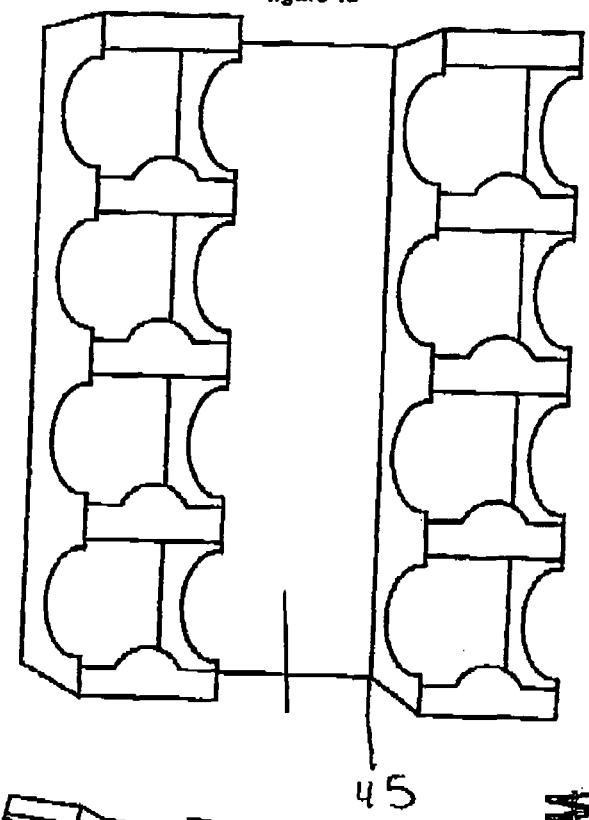
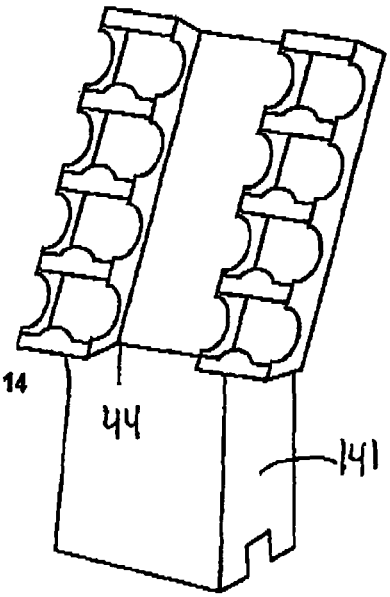
figure 14
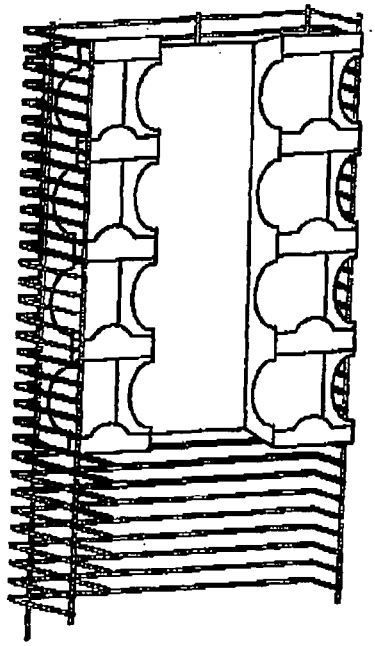
figure 15

DUAL CONTAINER DISPLAY WITH CENTER PANEL

This application claims benefit of priority of U.S. Provisional Patent Application No. 60/633,996, filed Dec. 7, 2004.

BACKGROUND OF THE INVENTION

1. Field of the Invention

The present invention relates generally to Many marketers are challenged with the need to create in-store pre-pack displays that are easy to set up and meet stringent size constraints set by retail stores. Also in our competitive retail environment there is more and more pressure on marketers to produce lower cost products and lower cost merchandisers to display their products in-store. This has forced many marketers to travel great distances, including overseas, to seek out low cost suppliers, as a result, these marketers often incur heavy shipping costs in delivering their finished goods to retailers. These high shipping costs often result in higher costs to the customers, or lower profits to the marketers and/or their retail partners. To manage these heavy shipping costs, there is a growing need for displays to ship more and more efficiently with minimal "empty or air" space, thereby maximizing the number of displays that will fit on a pallet. Any solutions to help maximize the number of displays on a pallet are welcomed by marketers that ship product over great distances.

Pressure from competition, and pressure from retailers wanting their stores to look more attractive to their customers, has created a demand for more attractive in-store displays that are more effective in selling thru the displayed product(s). These combined market pressures have created an ever growing need for temporary display solutions that are efficiently produced, easy to pre-pack with product, ship efficiently, are easy to set up in store. Further there is a need for these displays to be constructed with adequate space for displaying selling messages to help sell through the product(s) in store. And finally, even though in certain cases there may be some display construction solutions that work well for some types of products, there are no known display constructions that offer systematic solutions that offer the aforementioned features.

2. Description of the Prior Art

The marketplace has continually responded to the needs of these product marketers with a variety of temporary display solutions. On one end of the spectrum, there are plenty of merchandisers to choose from for efficiently shipping and displaying product at retail. These displays accomplish this by ensuring that the product(s) are compactly placed in the display with very little "empty" space around the product, thereby relying on the marketers, media advertising, product packaging, and in-store advertising and promotional vehicles to help sell thru the product in store. In many cases a small loose "header" card will be designed into the display to help the in store sales effort. Unfortunately, these displays although, low in cost, and often ship efficiently, are viewed as commodity displays designed to hold products and not as tools to help sell thru the product(s). Also, in the case of the "header" card, marketers are aware that, often these loose "header" cards are never placed in the display, and if they are, they will often be taken down before the product is sold thru. The reason for the untimely removal of the "header" may be because it is obstructing the customers, or retailers view, or it may be in the way of reaching other products, or it may be taken down by competitors browsing the store. There is strong evidence for this because more and more marketers are engaging outside merchandising companies to set up and manage their in store display activity, ensuring display compliance. This kind of maintenance, of course, comes at a heavy price. On the other end of the spectrum you will find well heeled marketers that spare no expense in building award winning displays that are extremely effective at selling thru product(s). These displays will allocate as much selling space in the display as is necessary to capture the customer's attention and to ensure strong sell thru. Unfortunately these displays, although very effective at helping sell through the product(s), often allocate a large proportion of the display to the selling message, leaving less space for the product. Also these displays are often comprised of several parts and are costly to produce and ship. Either they ship preassembled with plenty of "empty" space for the selling messages, or they ship knocked-down and require significant setup in-store by store personnel.

Of course, there are constant efforts on the part of marketers and display producers to create more efficient, low cost displays with more selling space designed into the construction, and conversely, there are efforts by fancy display makers to tone down they award winning displays so that they are more efficient to produce and ship. For example, you will now see many in-store displays that have been designed in a way that the "headers are either built into the construction of the display, or at minimum are locked into the display prior to shipment to ensure that they will stay on the display for a longer period of time. These efforts have had reasonably good success. However, they require more parts and/or more labor to accomplish the objective. As for toning down the fancy displays so that they are more cost effective to produce and ship, this is accomplished with a great deal of design time, with different levels of success depending on what features or "selling" space changes would be acceptable to the marketer. After all the more "empty" space there is in a display, the more space there is for messaging. Once that "empty" space is taken away, the less space there is available for the "selling" message.

Unfortunately, there are no known display constructions designed as pre-pack shippers that offer a structure that is systematically simple and low cost to produce, easy to set up, ship efficiently and has a meaningful space for a permanent selling message.

SUMMARY OF THE INVENTION

Against the foregoing background, it is the primary object of the present invention to provide a display with a structure that will effectively display a variety of different products at retail, and offer a large messaging space.

It is another object of the invention to provide a display that has customizable containers that will hold a variety of products at retail, without many separate parts, minimizing production and assembly costs.

It is another object of the present invention to have an optional folding structure so that if desired it may enjoy shipping efficiency.

It is yet another object of the present invention to offer a universal display solution that may be simply resized to fit many different products, to hold a variety of quantities of products, and to be used in many areas of the in-store environment, including: Floor Merchandisers, counter Displays, PDQ's, Clip Strips Power Wings and Sidekicks and other well know display constructions.

It is but another object of the present invention to make this display constructions from a variety of flexible materials such as paperboard, plastics and any other materials suitable for folding.

It is another object of the invention, to provide a display that is simple and easy to manufacture, not requiring any custom machinery, but rather to be manufactured on equipment that is readily available in the market.

It is yet still another object of the present invention, to provide a display that allows for the shelves to be assembled and filled with product, then stored separately from the base of the display, for final assembly at a future date, offering yet more flexibility in fulfillment options.

It is but another object of the present invention to provide a display that that requires a minimal parts to hold the materials, minimizing the die charges, and the need to inventory multiple parts.

It is yet another object of the present invention to provide a display that allows the flexibility of displaying different sized products and different quantities of products in the same display by altering the height and depth of shelves simply and easily.

It is yet another object of the invention to provide a display with a large messaging space that may be folded away for shipping.

It is yet another object of the current invention to provide a display that when folded can in many cases stack many more units per pallet without compromising the product count of each display.

It is another object of the invention to provide a display with a substantially flat profile that can be stored and shipped efficiently, and easily assembled at a future date.

It is yet another object of the invention to provide a display that may be converted into a finished display with a single pass on a specialty gluer.

Another object of the invention to provide a display that requires a small sheet of four color to be laminated on to the display to give the appearance of a full four color printed display.

To the accomplishments of the foregoing objects and advantages the present invention in brief summary comprises a flexible paper board, plastic or other suitable flexible material that can be die-cut and folded, and attached, by glue, tuck flaps or other suitable fastening means, so that when the structure is finally folded, it features two containers, separated by a center panel, that may be used to display "selling" or "informational" messages. The structure of the left and right containers is formed when one or more shelf flaps that are folded down and lock into a shelf slot at the rear of the display. The shelf flaps may serve as a shelf on which product (s) may be displayed.

BRIEF DESCRIPTION OF THE DRAWINGS

The foregoing and still other objects and advantages of the present invention will be more apparent from the detailed explanation of the preferred embodiments of the invention in connection with the accompanying drawings, wherein:

FIG. 4 is a plan view of a partial cut away of the flat profile of the paper board prior to folding.

FIG. 5 is a top view of paperboard being folded on scores and ready to be attached by glue or other suitable means.

FIG. 6 is a top view of paperboard with tabs and attached to rear of center panel.

FIG. 7 is a close-up of the top view of paperboard with an additional fold.

FIG. 8 is a top view of paperboard after it has been formed into a display structure.

FIG. 9 is a plan view of an alternative structure which is designed in such a way as to bring the center panel to the front of the display.

FIG. 10 is a perspective view of a partially assembled display of FIG. 9.

FIG. 11 is a top view of the assembled display where the containers are rotated behind the center panel for efficient storage and shipping.

FIG. 12 is a top view of the display shown in FIG. 11 in the open position.

FIG. 13 is a perspective view of the preferred embodiment of the display shown here as a counter display.

FIG. 14 is a perspective view of the preferred embodiment of the display shown here on a base serving as a floor merchandiser.

FIG. 15 is a perspective view of the preferred embodiment of the display shown here as a power wing or sidekick.

BRIEF DESCRIPTION OF THE PREFFERED EMBODIMENTS

Figure 1:
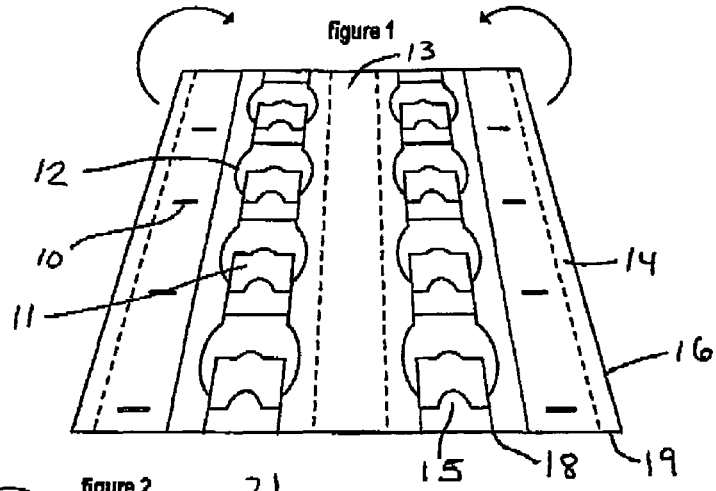
FIG. 1 is a plan view of a sheet of paper board that is die-cut and scored in such a way that it may be folded to form a display structure with two containers and a center panel.

Referring to the drawings and, in particular to FIG. 1 thereof the dual container display with center panel structure of the present invention is provided and referred to generally by the sheet of paper board 16 that is die-cut and scored in such a way that it may be folded to form a display structure with a center panel area 13, openings to display product 12, and shelf flaps 11, that would snap in to shelf slits creating functional shelves that could hold product for retail display. It is the intent of the inventor, to make the display minimally from one sheet of paper board, that would both function well as a retail display complete with a large messaging area, and it would if desired would fold compactly for shipping. It is further the intent of the inventor, to make this structure from any suitable paperboard, plastic or any other material that is flexible and easy to work with using conventional converting equipment.

Figure 2:
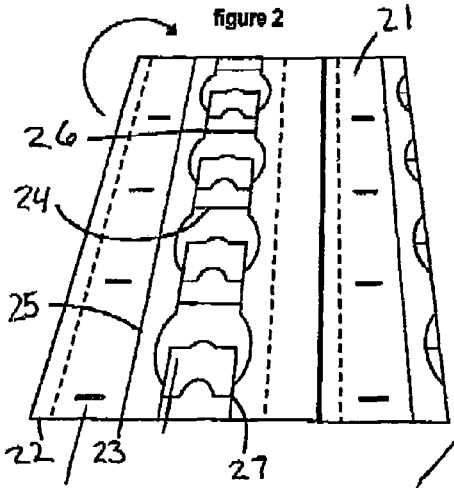
FIG. 2 is a top plan view where the right portion of the display was folded and glued to form the walls of one container, while the opposite side remains flat.
Figure 3:
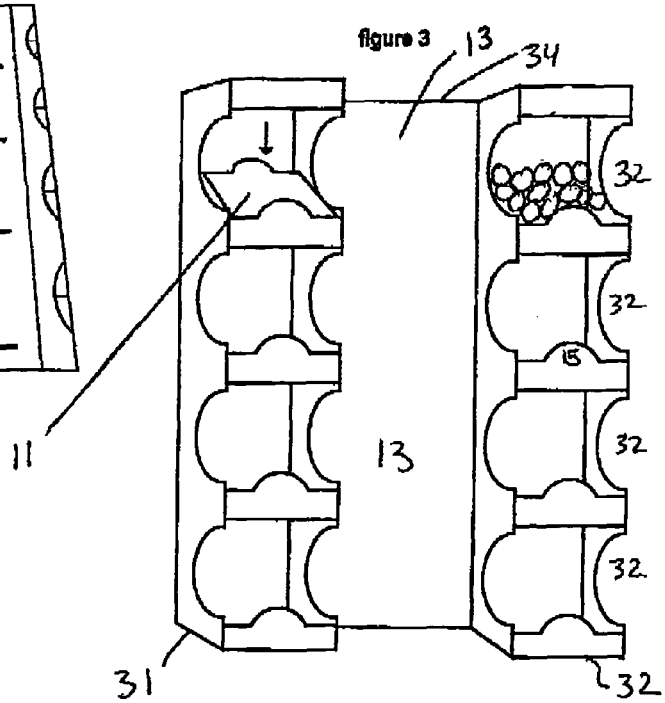
FIG. 3 is a perspective front view in which the flat profile shown in FIG. 2 has been formed to create a useful display structure consisting of right container, left container and center panel.

In the preferred embodiment, the right and left sides of the paperboard are folded and glued forming the right and left containers of the display. FIG. 2 is a plan view where the right portion of the display was folded on score 18 where tab 19 could be attached to the rear of center panel 13. The preferred embodiment would use glue to attach tab 19 to center panel 13, however it should be noted that any other suitable means of attachment may be used including but not limited to tuck flaps, tape, staples snaps etc. The left side tab 22 would be folded on score 23 and attached to the left side of the rear of center panel 13. Note in the preferred embodiment in order to minimize cost, the tabs 19 and 22 are separated by a space. It should be noted that these tabs may be extended to touch in the rear of the center panel as they are attached. FIG. 3 is a perspective view in which the flat profile shown in FIG. 2 has been formed to create a useful display structure consisting of right container 32, left container 31 and center panel 13. The structure of the containers is given by the shelf flap 11 that is pushed down until it locks into shelf slot 10. The height and width of the shelves may be altered by in increasing or decreasing the size of the blank paperboard and/or altering the distances between the scores in such a way that the containers would be formed with narrower or wider profiles, as necessary to best display the product(s). The height of the cavity within the containers 31 and 32 are determined by the position of the folds 24, 25, 26 and 27. By moving these folds up and down you can achieve different cavity heights 32. There are limitations to how short t a cavity may be, as the shelf tab 11 must be able to be folded down to lock into the rear of container 32 or 31 into shelf slot 10. If the shelf flap is too short to reach the rear of the container to fit into the shelf slot 10 then the cavity is too short and would need to be enlarged until the shelf flap 11 fits into the shelf slot 10. It is further the intent of the inventor to allow the marketer to decide whether the containers 31 and 32 are the same width or depth as shown in FIG. 3 or if they are of different and non-symmetrical in size. It is further the intent of the inventor to create tabs 15 from shelf flap 11 to help hold product in the display. Although the preferred embodiment of the display is to form the display from a rectangular or square paperboard sheet for optimum efficiency It is further the intent of the inventor to allow for additional board to create top and/or bottom flap closures for containers 31 and 32 (not shown). It is further the intent of the inventor to increase or decrease the size of shelf tab 11 and to move up or down the shelf slot 10 in such a way as to create special angles in the position of the shelf flap so as to cause the products stacked in the display to lean forward or backward as desired by the marketer increasing or decreasing the tilt created by the angle of the self tab and the shelf slot (not shown). It is also the intent of the inventor to allow for the perimeter of the top and bottom of the display to have a non symmetrical shape, making it ideal for creating special die-cuts and interesting shapes that would enhance the merchandising of the products in the display. It is further the intent of the inventor, to have a more secure locking mechanism in instances where the product is heavy, where shelf tab 11 would have a score across the complete edge forming a full tab that would lock into a receiving "U" slit in the rear of the display (not shown). For additional shelf strength, additional flaps may be added to the shelf by extending the shelf to the right and/or left, and folding it so that it is perpendicular to the shelf, giving the shelf more strength (not shown).

In the preferred embodiment of the invention, a series of well placed scores allows the formation of this special structure. FIG. 4 is a plan view of a partial cut away of the flat profile of the paper board prior to folding. To manufacture this display using conventional means so that it folds into two containers 31 and 32 it is necessary at minimum to have several scores in relation to each other in such a way that when are glued and folded they can easily be formed into two containers 31 and 32 on either side of center panel 14. some critical dimensions are as follows: the space 51 between scores 41 and 42 forms the rear of container 31 must be approximately the same size to space 52 between scores 18 and 43 forming the front of container 31; The space 53 between scores 46 and 47 forms the front of container 32 must be approximately the same size to the space 54 between scores 48 and 49 forming the rear of container 32; respectively the space 55 and 56 must be close in size to form the right and left sides of the container 32. And the space 57 and 58 must be close in size to form the right and left sides of container 31. It is further the intent of the inventor, to form the structure is such a way that the center panel of the display is to the front of the display rather than to the back, making it easier to view the center panel and its promotional or informational message. To accomplish this section 57 is moved to between sections 51 and 19 on the right side, and section 56 is moved between sections 50 and 54 on the left side. By making these panel switches the center panel is moved from the from to the back (not shown). FIG. 5 is a top view of paperboard 16 being folded on scores 18 and 47 ready to be attached by glue or other suitable means. FIG. 6 is a top view of paperboard 16 with tabs 50 and 19 attached to rear of center panel 13. FIG. 7 is a close up of the top view of paperboard 16 with an additional fold on score 41 and score 49 (not shown). Although the preferred embodiment is not to create the additional fold, in certain instances where the paper board is heavier as in B flute corrugated stock having the extra fold on score 41 and gluing the tab to the inside of the containers 31 and 32 will minimize and or eliminate the stress of having to fold the containers on a joint comprised of two thicknesses of paperboard (not shown).

FIG. 8 is a top view of paperboard 16 after it has been formed into a display structure. It is further the intent of the inventor, to have folds 45 and 44 to act as a hinge for the purposes of allowing the final display structure to easily fold for efficient shipping. This is easily accomplished by having one or both containers 31 and 32 rotate to the front or the rear of the center panel 13 using folds 44 and 45 as a hinge (not shown). In this way the display may have a more compact profile making the display more efficient to ship. Although it is the preferred embodiment of the invention to have the right and left containers oriented to ace the front as does the center panel, It is the intent of the inventor to have the structure formed in such a way, that by eliminating certain scores the orientation of the right and left containers may be altered, such as the containers are would permanently face to the right and to the left of the center panel if scores 45 and 44 were removed (not shown).

An alternative embodiment of the invention is shown in FIG. 9. This plan view of an alternative structure is also designed in such a way as to bring the center panel to the front of the display. Although the earlier structure FIG. 3 requires less paperboard to produce, the structure is designed in such a way that the center panel 13 is to the back of the display in relation to the front of containers 31 and 32. It is the intent of the inventor to offer a display option that brings the center panel 91 to the front of the display. It is important to note that a series of flap closures are included and to lock the trays and two additional panels 99 and 100 were added that will form the front of the containers when the display is assembled. The shelf flaps 92 are die cut from panels 99 and 100 and pushed down to lock into shelf slots 94 located in the rear panels of the containers 101 and 102. FIG. 10 is a perspective view of a partially assembled display where the flap closures 97, 98 and 96 are locked together using conventional roll over closure folds to form the structure of containers 101 and 102. The front of container 101 is formed by folding panel 99 over the top of container 101 and tucking in flaps 103, 104, and 105 into the perimeter formed by the right side of the center panel 91 and the formed sides of container 10 to maintain closure a tab 93 with a flap is inserted into opening 95. The same actions are repeated to form container 102. The shelves are then formed by pushing shelf flap 92 down until it locks into the rear shelf slot 94. FIG. 11 is a top view of the assembled display where the containers 101 and 102 are rotated behind the center panel 91 for efficient storage and shipping. It is important to note that it is the intention of the inventor to allow the containers 101 and 102 to be of different sizes to accommodate different products in the same display. It is further the intention of the inventor to eliminate the "empty" space 200 found behind the center panel in FIG. 12 by rotating the containers to the back of the display eliminating the "empty" space and forming an efficient profile for shipping. FIG. 12 is a top view of the display in the open position where containers

101 and 102 are on either side of the center panel 91. Note that in this construction the center panel 91 is to the front of the display.

In the preferred embodiment of the invention the same display construction may be used for a variety of in-store display applications. FIG. 13 is a perspective view of the preferred embodiment of the display shown here as a counter display. FIG. 14 is a perspective view of the preferred embodiment of the display shown here on a base 141 serving as a floor merchandiser. FIG. 15 is a perspective view of the preferred embodiment of the display shown here as a power wing or sidekick. This style of display is especially important to marketers who merchandise their products in these fixtures because these styles of store fixtures are reserved for impulse items and high volume goods. Being able to have a lot of messaging and display space next to your product in this location and may be key to the success of the product(s). It is important to note that these style fixtures have specific display size limits, otherwise the displays will not fit into these fixtures. The industry giant Wal-Mart and many other large retailers have chosen power wing structures that measure 14" long×48" high×3½" deep strategically located And most retailers insist that the power wing displays are 24" tall, so that two displays may be merchandised on top of one another in a 48" power wing space. This creates a unique problem for some marketers and a specific opportunity for our invention. Those marketers that have products that will not fit snugly across in the 14", as in a product that measures 5" across (not shown). When the products are laid out side by side as they would in the display, you would only be able to fit two items across leaving an unusable space of 4". A marketer in this situation would have two options; make a narrower display, which is not desired as it minimizes their foot print in the store, or fill the extra space in the display with a selling message. This option is also not very desirable because empty space behind the insert, though may provide valuable space for selling messages, it also is responsible for higher than necessary shipping costs, as the display is larger than it needs to be, for the amount of product that is being shipped. With our invention, this marketer would have both the necessary messaging space on center panel 13, and, because of the displays unique folding ability, the cost of shipping would be lower because they would be shipping a smaller package, as the empty space behind the center panel (not shown) would disappear when the display is folded for shipment.

Wherefore, I claim:

1. A foldable shelving display, foldable between an assembled configuration and an unassembled configuration, the foldable shelving display comprising:

a single flexible sheet of material having a plurality of scored and cut sections, the single sheet being foldable into the assembled configuration to create a three-dimensional shelf, the three-dimensional shelf including:

a first vertical column structure having a plurality of planar shelves integrated therewith, a second vertical column structure having a plurality of planar shelves integrated therewith, and a center panel hingedly coupled to, and disposed between, the first vertical column structure and the second vertical column structure, wherein the pluralities of planar shelves are substantially perpendicular to the center panel, and wherein, in the assembled configuration, the center panel is coupled to the first vertical column structure by a first hinge and the center panel is coupled to the second vertical column structure by a second hinge, wherein the center panel, the first vertical column, and the second vertical column are independently positioned relative to one another such that, in the assembled configuration, at least one of the first vertical column structure and second vertical column structure is configured to rotate along the first hinge or the second hinge towards the center panel.

2. The foldable shelving display of claim 1, wherein each planar shelf of the pluralities of planar shelves includes a shelf tab configured to fold down to lock into a shelf slot.

* * * * *